US010345727B2

(12) United States Patent
Komada

(10) Patent No.: US 10,345,727 B2
(45) Date of Patent: Jul. 9, 2019

(54) POSITIVELY CHARGEABLE TONER AND TWO-COMPONENT DEVELOPER

(71) Applicant: KYOCERA Document Solutions Inc., Osaka (JP)

(72) Inventor: Ryotaro Komada, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/128,855

(22) Filed: Sep. 12, 2018

(65) Prior Publication Data

US 2019/0086826 A1 Mar. 21, 2019

(30) Foreign Application Priority Data

Sep. 21, 2017 (JP) ..... 2017-181162

(51) Int. Cl.

| | |
|---|---|
| ***G03G 9/087*** | (2006.01) |
| ***G03G 9/093*** | (2006.01) |
| ***G03G 15/02*** | (2006.01) |

(52) U.S. Cl.

CPC ..... *G03G 9/08711* (2013.01); *G03G 9/08755* (2013.01); *G03G 9/09307* (2013.01); *G03G 15/0208* (2013.01)

(58) Field of Classification Search

CPC ..... G03G 9/08711; G03G 9/09307; G03G 9/08755; G03G 15/0208

See application file for complete search history.

(56) References Cited

U.S. PATENT DOCUMENTS

2009/0325099 A1* 12/2009 Watanabe ..... G03G 9/0806 430/108.4

FOREIGN PATENT DOCUMENTS

JP 2004-240158 A 8/2004

* cited by examiner

*Primary Examiner* — Thorl Chea

(74) *Attorney, Agent, or Firm* — Studebaker & Brackett PC

(57) ABSTRACT

A positively chargeable toner includes a plurality of toner particles each including a toner mother particle and an external additive attached to a surface of the toner mother particle. The external additive includes first resin particles each having a surface to which a cationic surfactant is attached and second resin particles each having a surface to which a cationic surfactant is attached. The first resin particles have a hydrophobicity of at least 15% and no greater than 30%. The second resin particles have a hydrophobicity of at least 50% and no greater than 80%. A first resin particle coverage ratio and a second resin particle coverage ratio each are at least 10% and no greater than 30%. Each blocking rate of the first resin particles and the second resin particles is no greater than 30% by mass.

10 Claims, No Drawings

POSITIVELY CHARGEABLE TONER AND TWO-COMPONENT DEVELOPER

INCORPORATION BY REFERENCE

The present application claims priority under 35 U.S.C. § 119 to Japanese Patent Application No. 2017-181162, filed on Sep. 21, 2017. The contents of this application are incorporated herein by reference in their entirety.

BACKGROUND

The present disclosure relates to a positively chargeable toner and a two-component developer.

A toner has been known that includes toner mother particles containing at least a binder resin and a colorant and each having a surface to which at least negatively chargeable resin fine particles and positively chargeable inorganic fine particles are attached.

SUMMARY

A positively chargeable toner according to the present disclosure includes a plurality of toner particles each including a toner mother particle and an external additive attached to a surface of the toner mother particle. The external additive includes first resin particles each having a surface to which a cationic surfactant is attached and second resin particles each having a surface to which a cationic surfactant is attached. The first resin particles have a number average primary particle diameter of at least 30 nm and no greater than 65 nm. The second resin particles have a number average primary particle diameter of at least 80 nm and no greater than 120 nm. The first resin particles have a hydrophobicity measured by a methanol wettability method of at least 15% and no greater than 30%. The second resin particles have a hydrophobicity measured by the methanol wettability method of at least 50% and no greater than 80%. An area ratio of a region of a surface region of the toner mother particle that is covered with the first resin particles is at least 10% and no greater than 30%. An area ratio of a region of the surface region of the toner mother particle that is covered with the second resin particles is at least 10% and no greater than 30%. A blocking rate as measured for the first resin particles using a mesh having an opening size of 75 μm after 5-minute application of a pressure of 0.1 kgf/mm$^2$ at a temperature of 160° C. to the first resin particles is no greater than 30% by mass. A blocking rate as measured for the second resin particles using a mesh having an opening size of 75 μm after 5-minute application of a pressure of 0.1 kgf/mm$^2$ at a temperature of 160° C. to the second resin particles is no greater than 30% by mass.

A two-component developer according to the present disclosure includes the positively chargeable toner according to the present disclosure and a carrier that positively charges the positively chargeable toner by friction therewith.

DETAILED DESCRIPTION

An embodiment of the present disclosure will be described below. Note that unless otherwise stated, results (for example, values indicating shapes or properties) of evaluations that are performed on for example toner cores, toner mother particles, an external additive, a toner, or a carrier are number averages of measurements made with respect to an appropriate number of particles.

A number average particle diameter of particles is a number average value of equivalent circle diameters of primary particles (Heywood diameters: diameters of circles having the same areas as projections of the particles) measured using a microscope, unless otherwise stated. A measured value of a volume median diameter ($D_{50}$) of particles is a value measured using a laser diffraction/scattering particle size distribution analyzer ("LA-750", product of Horiba, Ltd.), unless otherwise stated.

A "main component" of a material herein refers to a component included the most in the material in terms of a mass basis, unless otherwise stated. Chargeability herein refers to chargeability in triboelectric charging, unless otherwise stated. Strength of tendency to be positively charged (or strength of tendency to be negatively charged) in triboelectric charging can be confirmed for example using a known triboelectric series.

Note that in the present description the term "-based" may be appended to the name of a chemical compound in order to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof. Also, the term "(meth)acrylic" herein is used as a generic term for both acrylic and methacrylic. The term "(meth)acrylonitrile" herein is used as a generic term for both acrylonitrile and methacrylonitrile.

In the following description, both untreated silica particles (also referred to below as a "silica base") and silica particles obtained through surface treatment on the silica base (that is, surface-treated silica particles) are referred to as "silica particles". Also, silica particles hydrophobidized with a surface treatment agent may be referred to as "hydrophobic silica particles" and silica particles made positively chargeable with a surface treatment agent may be referred to as "positively chargeable silica particles". All of untreated titanium oxide particles (also referred to below as a "titanium oxide base"), titanium oxide particles obtained through surface treatment on the titanium oxide base (surface-treated titanium oxide particles), and titanium oxide particles each including a conductive layer on a surface thereof are referred to as "titanium oxide particles". Titanium oxide particles as result of a titanium oxide base being covered with a conductive layer (that is, titanium oxide particles made conductive with the coat layer) may be referred to as "conductive titanium oxide particles".

A toner according to the present embodiment is a positively chargeable toner. The positively chargeable toner includes a plurality of toner particles (particles having below-described features). The toner according to the present embodiment can be favorably used for development of electrostatic latent images. The toner may be used as a one-component developer. Alternatively, the toner may be mixed with a carrier using a mixer (for example, a ball mill) to prepare a two-component developer. An example of carriers suitable for image formation is a ferrite carrier (specifically, ferrite particles). In order to form high-quality images for an extended term, it is preferable to use magnetic carrier particles each including a carrier core and a resin layer covering the carrier core. In order to ensure sufficient charging ability of a carrier to a toner for an extended term, it is preferable that the resin layer fully covers a surface of the carrier core (that is, no region of a surface region of the carrier core is exposed through the resin layer). In order to make the carrier particles magnetic, the carrier cores may be formed from a magnetic material (for example, a ferromagnetic material such as ferrite) or a resin in which magnetic particles are dispersed. Alternatively, magnetic particles may be dispersed in the resin layer covering the carrier core. Examples of resins forming the resin layer include at least one resin selected from the group consisting of fluororesins (specific examples include perfluoroalkoxy alkane (PFA) and fluorinated ethylene-propylene (FEP)), polyimide-imide resins, silicone resins, urethane resins, epoxy resins, and phenolic resins. An amount of the toner in the two-component developer is preferably at least 5 parts by mass and no greater than 15 parts by mass relative to 100 parts by mass of the carrier in order to achieve high-quality image formation. The carrier preferably has a number average primary particle diameter of at least 20 μm and no greater than 120 μm. Note that the positively chargeable toner included in the two-component developer is charged positively by friction with the carrier.

The toner according to the present embodiment can be used for image formation using for example an electrophotographic apparatus (image forming apparatus). The following describes an example of image forming methods using an electrophotographic apparatus.

First, an image forming section (for example, a charger and a light exposure device) of the electrophotographic apparatus forms an electrostatic latent image on a photosensitive member (for example, a surface portion of a photosensitive drum) based on image data. Subsequently, a development device of the electrophotographic apparatus (specifically, a development device loaded with developer including toner) supplies the toner to the photosensitive member to develop the electrostatic latent image formed on the photosensitive member. The toner is charged by friction with carrier, a development sleeve, or a blade in the development device before being supplied to the photosensitive member. The positively chargeable toner is charged positively. In a development process, the toner (specifically, the charged toner) on the development sleeve (for example, a surface portion of a development roller in the development device) disposed in the vicinity of the photosensitive member is supplied onto the photosensitive member and attached to a portion of the electrostatic latent image on the photosensitive member that is exposed to light, thereby forming a toner image on the photosensitive member. The development device is replenished with toner in an amount corresponding to an amount of toner consumed in the development process from a toner container loaded with toner for replenishment use.

In a subsequent transfer process, a transfer device of the electrophotographic apparatus transfers the toner image from the photosensitive member to an intermediate transfer member (for example, a transfer belt), and further transfers the toner image from the intermediate transfer member to a recording medium (for example, paper). Thereafter, a fixing device (fixing method: nip fixing using a heating roller and a pressure roller) of the electrophotographic apparatus fixes the toner to the recording medium by applying heat and pressure to the toner. Through the above, an image is formed on the recording medium. For example, a full color image can be formed by superimposing toner images in four colors of black, yellow, magenta, and cyan. After the transfer process, residual toner on the photosensitive member is removed by a cleaning member (for example, a cleaning blade). Note that the transfer process may be a direct transfer process by which the toner image on the photosensitive member is transferred directly to the recording medium not using the intermediate transfer member.

The toner according to the present embodiment is a positively chargeable toner having the following features (also referred to below as basic features).

(Basic Features of Toner)

The toner includes a plurality of toner particles each including a toner mother particle and an external additive attached to a surface of the toner mother particle. The external additive includes first resin particles each of which has a surface to which a cationic surfactant is attached (also referred to below simply as "first resin particles") and second resin particles each of which has a surface to which a cationic surfactant is attached (also referred to below simply as "second resin particles"). Each of an area ratio of a region of a surface region of the toner mother particle that is covered with the first resin particles and an area ratio of a region of the surface region of the toner mother particle that is covered with the second resin particles is at least 10% and no greater than 30%. The first resin particles and the second resin particles have the following features.

(First Resin Particles)

The first resin particles have a number average primary particle diameter of at least 30 nm and no greater than 65 nm. The first resin particles have a hydrophobicity measured by a methanol wettability method of at least 15% and no greater than 30%. A blocking rate as measured for the first resin particles using a mesh having an opening size of 75 μm after 5-minute application of a pressure of 0.1 kgf/mm$^2$ at a temperature of 160° C. is no greater than 30% by mass.

(Second Resin Particles)

The second resin particles have a number average primary particle diameter of at least 80 nm and no greater than 120 nm. The second resin particles have a hydrophobicity measured by the methanol wettability method of at least 50% and no greater than 80%. A blocking rate as measured for the second resin particles using a mesh having an opening size of 75 μm after 5-minute application of a pressure of 0.1 kgf/mm$^2$ at a temperature of 160° C. is no greater than 30% by mass.

In the aforementioned basic features, methods for measuring a number average primary particle diameter, a hydrophobicity, and a blocking rate are the same as those described in Examples or methods conforming therewith. In the following description, a hydrophobicity and a blocking rate each defined in the aforementioned basic features may be referred to as an "MW hydrophobicity" and a "BL rate", respectively. Also, an area ratio of a region of the surface region of the toner mother particle that is covered with the external additive may be referred to as an "external additive coverage ratio". For example, an area ratio of the region of the surface region of the toner mother particle that is covered with the first resin particles may be referred to as a "first resin particle coverage ratio".

Thermal-stress resistance of a toner can be improved by attaching resin particles (an external additive) to surfaces of toner mother particles. The resin particles preferably have a number average primary particle diameter of at least 80 nm in order to ensure sufficient thermal-stress resistance of the toner through the resin particles functioning as spacers among the toner particles. However, the present inventor found that the following problems are posed in a situation in which the resin particles are used as an external additive of the toner particles. The present inventor trying to solve such problems accordingly invented a positively chargeable toner having the aforementioned basic features.

(First Problem)

Typically, resin particles have not so strong tendency to be positively chargeable. Therefore, use of the resin particles as an external additive makes it difficult to ensure sufficient positive chargeability of the toner.

(Second Problem)

Toner remaining on a photosensitive drum in a typical image forming apparatus is removed together with extraneous matter on the photosensitive drum by a cleaner after a transfer process. For example, in blade cleaning, extraneous matter on the photosensitive drum is scraped and removed in a manner that a surface of the photosensitive drum is rubbed by an edge of a cleaning blade. When toner particles including resin particles as an external additive are used for continuous printing in such an image forming apparatus, the resin particles are detached from the toner particles and the detached resin particles are attached to the surface of the photosensitive drum. In a situation in which the surface of the photosensitive drum is cleaned by blade cleaning, the resin particles present on the surface of the photosensitive drum are caught between the photosensitive drum and the cleaning blade to be heated and pressurized by friction. When the resin particles are thermally compressed (specifically, plastically deformed) by application of heat and pressure to adhere to the surface of the photosensitive drum, it is difficult to form a high-quality image. Specifically, a dash mark (image defect caused due to adhesion of matter present on the surface of the photosensitive drum) is liable to be formed on a formed image.

(Third Problem)

Typically, a two-component developer (toner and carrier) is used while being stirred in a development device. When an external additive of toner particles is detached from the toner particles by being stirred, the detached external additive may be attached to carrier particles. When the external additive of the toner particles is attached to the carrier particles in the development device, charging ability of the carrier varies, with a result that the amount of charge of the toner tends to be excessive or insufficient. When the amount of charge of the toner is not at an appropriate level, quality of an image formed with the toner may reduce.

The present inventor repeatedly carried out experiments and examinations in order to solve the first problem to find that chargeability of resin particles can be adjusted by attaching a cationic surfactant to surfaces of the resin particles. Positive chargeability of the resin particles can be increased by attaching a cationic surfactant to the surfaces of the resin particles.

A nonionic surfactant may be additionally attached to at least one of a surface of each first resin particle and a surface of each second resin particle. A nonionic surfactant influences chargeability of resin particles less than a cationic surfactant and an anionic surfactant. That is, chargeability of the resin particles is not so varied even when a nonionic surfactant is attached to the surfaces of the resin particles. As described above, chargeability of the resin particles can be adjusted by attaching a cationic surfactant to the surfaces of the resin particles. However, use of only a cationic surfactant in production of the resin particles may result in insufficient dispersibility of the resin particles or a material thereof (resin raw material). In a situation as above, addition of a nonionic surfactant in addition to the cationic surfactant can facilitate ensuring sufficient dispersibility of the resin particles or the material thereof (resin raw material). Examples of nonionic surfactants include fatty acid ester derivatives (specific examples include glycerin fatty acid ester and sorbitan fatty acid ester), polyoxyalkylene alkyl ether derivatives (specific examples include polyoxyethylene lauryl ether), polyoxyalkylene phenyl ether derivatives (specific examples include polyoxyethylene styrenated phenyl ether), and fatty acid amide derivatives (specific examples include fatty acid alkanolamide).

The present inventor repeatedly carried out experiments and examinations in order to solve the second problem to find that resin particles (external additive) hardly adhere to a surface of a photosensitive drum by setting the BL rate of the resin particles to be no greater than 30% by mass. The BL rate of the resin particles in the aforementioned basic features indicates readiness to be thermally compressed. The larger the BL rate of the resin particles is, the more the resin particles tend to be readily thermally compressed. In the aforementioned basic features, when each BL rate of the first resin particles and the second resin particles is excessively high, contamination of the photosensitive member (specifically, adhesion of the resin particles to the surface of the photosensitive drum) tends to readily occur upon application of heat and pressure to the resin particles in blade cleaning (see for example a toner TB-5 described later). The smaller the BL rate of the resin particles is, the more excellent in heat resistance and the harder the resin particles are, with a result that the resin particles tend to hardly agglomerate. Production of very hard resin particles is thought to be necessary in order to set the BL rate of the resin particles to be no greater than 30% by mass. The present inventor succeeded in attaining a BL rate of the resin particles of no greater than 30% by mass through use of a highly pure cross-linking agent. For example, in a situation in which divinylbenzene is used as a cross-linking agent, divinylbenzene having a purity (mass fraction) of around 50% is used typically. However, a BL rate of resin particles of no greater than 30% by mass was attained through use of divinylbenzene having a purity (mass fraction) of 80%. The BL rate of the resin particles can be adjusted for example by changing the amount of a cross-linking agent in resin synthesis. As the amount of the cross-linking agent is increased, the number of cross-linking points increases to harden the resin particles and the BL rate of the resin particles tends to be smaller.

The present inventor repeatedly carried out experiments and examinations in order to solve the third problem to find that variation in chargeability of a toner in continuous printing can be inhibited by using two types of resin particles (first resin particles and second resin particles) having different particle diameters and different MW hydrophobicities as an external additive to cover surfaces of toner mother particles at respective appropriate coverage ratios.

As described above, when an external additive detached from toner mother particles is attached to carrier particles, charging ability of the carrier may vary. In order to inhibit variation in charging ability of a carrier, it is preferable to reduce an amount of detached external additive. In the toner having the aforementioned basic features, the amount of detached external additive is reduced by setting each of the first resin particle coverage ratio and the second resin particle coverage ratio sufficiently low. When the first resin particle coverage ratio and the second resin particle coverage ratio are set at at least 10% and no greater than 30%, the amount of detached external additive can be sufficiently reduced while the first resin particles and the second resin particles in an amount sufficient to function as an external additive are allowed to be present on the surfaces of the toner mother particles. In also the toner having the aforementioned basic features, the second resin particles have a number average primary particle diameter of at least 80 nm and no greater than 120 nm. The second resin particles, which are large enough to function as spacers, are held sufficiently stably on the toner mother particles. The larger the particle diameter of the external additive particles is, the more the external additive particles tend to be detached from the toner mother particles. When the second resin particles have an excessively large number average primary particle diameter, the amount of detached second resin particles is excessively large, thereby readily causing fogging (see a toner TB-4 described later, for example).

When highly hydrophilic external additive particles are attached to carrier particles, surfaces of the carrier particles tend to adsorb moisture in the air in a high humidity environment. When moisture is adsorbed to the surfaces of the carrier particles, charging ability of the carrier tends to significantly decrease. The second resin particles of the toner having the aforementioned basic features have a sufficiently high MW hydrophobicity. Specifically, the second resin particles have a MW hydrophobicity of at least 50% and no greater than 80%. The second resin particles having a particle diameter larger than that of the first resin particles tend to be readily detached from the toner mother particles. However, even when the second resin particles, which have a sufficiently high MW hydrophobicity, are attached to the surfaces of the carrier particles, hydrophilicity of the carrier particles is not excessively increased in the presence of the second resin particles. Setting the MW hydrophobicity of the second resin particles to be at least 50% and no greater than 80% can facilitate ensuring sufficient charging ability of the carrier.

The first resin particles having a particle diameter smaller than that of the second resin particles tend to be hardly detached from the toner mother particles. Therefore, properties of the first resin particles have great influence on chargeability of the toner. The first resin particles have a number average primary particle diameter of at least 30 nm and no greater than 65 nm. When the first resin particles have a MW hydrophobicity of at least 15% and no greater than 30%, a toner can be obtained that has an appropriate amount of charge in each of a low humidity environment and a high humidity environment. When the first resin particles have an excessively high MW hydrophobicity, the toner tends to be excessively charged in a low humidity environment (see a toner TB-2 described later, for example). When the first resin particles have an excessively low MW hydrophobicity, an amount of charge of the toner tends to be lower than an appropriate range in a high humidity environment (see a toner TB-1 described later, for example).

As described above, use of the positively chargeable toner having the aforementioned basic features can enable continuous formation of high-quality images and inhibit fogging and adhesion of foreign matter to the photosensitive member in continuous printing.

Toner mother particles (toner cores in a case of capsule toner mother particles described later) that melt at low temperature can be obtained through the toner mother particles containing a polyester resin in the aforementioned basic features. Fluidity of the toner can be improved through the external additive further including silica particles having a number average primary particle diameter of at least 3 nm and no greater than 20 nm in the aforementioned basic features. When silica particles have an appropriately small particle diameter, the toner can be easily made to have fluidity. However, when toner mother particles (toner cores in a case of the capsule toner mother particles) that melt at low temperature are used, the silica particles tend to be embedded in the toner mother particles (or the toner cores) under thermal stress. When the silica particles are embedded as above, fluidity and chargeability of the toner tend to vary. The external additive of the toner having the aforementioned basic features includes the second resin particles having a large particle diameter. The presence of not only the silica particles having a small particle diameter but also the second resin particles having a large particle diameter on the surfaces of the toner mother particles makes the silica particles hardly receive stress to prevent the silica particles from being embedded in the toner mother particles. Preferably, the first resin particles and the second resin particles each contain a cross-linked styrene-acrylic acid-based resin. The cross-linked styrene-acrylic acid-based resin is excellent in chargeability, and use thereof can facilitate production of fine particles having uniform shape and dimension when compared to use of for example a melamine resin. The cross-linked styrene-acrylic acid-based resin is excellent also in durability and charge stability. As to charge stability, the amount of charge is prevented from decreasing to a value lower than an appropriate range thereof particularly in a high-temperature and high-humidity environment. Furthermore, in a configuration in which the first resin particles and the second resin particles each contain a cross-linked styrene-acrylic acid-based resin, the first resin particles and the second resin particles exhibit almost the same charging behavior to inhibit abnormal charging of the toner.

In order to obtain a toner suitable for image formation, it is particularly preferable that: the cross-linked styrene-acrylic acid-based resin contained in the first resin particles and the cross-linked styrene-acrylic acid-based resin contained in the second resin particles each are a polymer of monomers (resin raw materials) including methacrylic acid alkyl ester having at an ester moiety thereof an alkyl group having a carbon number of at least 1 and no greater than 4, a styrene-based monomer, and a cross-linking agent having at least two unsaturated bonds; and the cationic surfactant attached to the surfaces of the first resin particles and the cationic surfactant attached to the surfaces of the second resin particles each are a nitrogen-containing cationic surfactant. At least one surfactant selected from the group consisting of alkyl trimethylammonium salts having an alkyl group having a carbon number of at least 10 and no greater than 25 and alkylamine acetate having an alkyl group having a carbon number of at least 10 and no greater than 25 is particularly preferable as the respective nitrogen-containing cationic surfactants. In order to sufficiently increase each MW hydrophobicity of the first resin particles and the second resin particles, each of the cross-linked styrene-acrylic acid-based resin contained in the first resin particles and the cross-linked styrene-acrylic acid-based resin contained in the second resin particles preferably includes no repeating unit having an alcoholic hydroxyl group.

The toner mother particles may be toner mother particles each having no shell layer (also referred to below as non-capsule toner mother particles) or toner mother particle each having a shell layer (also referred to below as capsule toner mother particles). Capsule toner mother particles can be produced by forming shell layers on surfaces of non-capsule toner mother particles (toner cores). The shell layers may be substantially made from a thermosetting resin or a thermoplastic resin or may contain both a thermoplastic resin and a thermosetting resin.

Where the toner mother particles in the aforementioned basic features are capsule toner mother particles, the shell layers preferably have the following features in order to cause the shell layers to have appropriate surface adsorption force while ensuring sufficient heat-resistant preservability, fixability, and chargeability of the toner. Each shell layer includes a resin film mainly formed from an agglomerated mass of resin particles having a glass transition point of at least 50° C. and no greater than 100° C. In the following description, the resin particles having a glass transition point of at least 50° C. and no greater than 100° C. among resin particles forming the resin film will be referred to as "thermally resistant particles". Where the resin film includes at least two types of resin particles, at least 80% by mass of resin particles among the at least two types of resin particles are preferably the thermally resistant particles. Alternatively, the resin film may be formed only from the thermally resistant particles. The thermally resistant particles forming the resin film have a number average roundness of at least 0.55 and no greater than 0.75. The thermally resistant particles contain a resin including at least one repeating unit derived from a styrene-based monomer, at least one repeating unit having an alcoholic hydroxyl group, and at least one repeating unit derived from a nitrogen-containing vinyl compound. A repeating unit having the highest mass ratio among repeating units included in the resin contained in the thermally resistant particles is a repeating unit derived from a styrene-based monomer.

The toner preferably has a volume median diameter ($D_{50}$) of at least 4 μm and no greater than 9 μm in order to obtain a toner suitable for image formation.

The following describes a preferable example of a configuration of the toner particle. A non-essential component may be omitted according to intended use of the toner.

[Toner Core]

The toner cores contain a binder resin. The toner cores may further contain an internal additive (for example, at least one of a colorant, a releasing agent, a charge control agent, and a magnetic powder).

(Binder Resin)

The binder resin is typically a main component of a toner. In a preferable example of a magnetic toner including a magnetic powder, the binder resin constitutes approximately 60% by mass of components of toner cores. In a preferable example of a non-magnetic toner including no magnetic powder, the binder resin constitutes approximately 85% by mass of components of toner cores. Therefore, properties of the binder resin are thought to have a large influence on overall properties of the toner cores.

Examples of preferable binder resins include styrene-based resins, acrylic acid-based resins (specific examples include acrylate polymers and methacrylate polymers), olefin-based resins (specific examples include polyethylene resins and polypropylene resins), vinyl chloride resins, polyvinyl alcohols, vinyl ether resins, N-vinyl resins, polyester resins, polyamide resins, and urethane resins. Alternatively, it is possible to use a copolymer of any of the above resins, that is, a copolymer of any of the above resins into which an arbitrary repeating unit is introduced (specific examples include styrene-acrylic acid-based resins and styrene-butadiene-based resins).

In order to achieve both heat-resistant preservability and low-temperature fixability of the toner, the toner cores preferably contain at least one of a polyester resin and a styrene-acrylic acid-based resin, and particularly preferably contain a polyester resin.

A polyester resin can be obtained by condensation polymerization of at least one polyhydric alcohol (specific examples include aliphatic diols, bisphenols, and tri- or higher-hydric alcohols as below listed) and at least one polybasic carboxylic acid (specific examples include dibasic carboxylic acids and tri- or higher-basic carboxylic acids as listed below). Furthermore, the polyester resin may include a repeating unit derived from another monomer (monomer other than the polyhydric alcohols and polybasic carboxylic acids).

Examples of preferable aliphatic diols include diethylene glycol, triethylene glycol, neopentyl glycol, 1,2-propanediol, α,ω-alkanediols (specific examples include ethylene glycol, 1,3-propanediol, 1,4-butanediol, 1,5-pentanediol, 1,6-hexanediol, 1,7-heptanediol, 1,8-octanediol, 1,9-nonanediol, and 1,12-dodecanediol), 2-butene-1,4-diol, 1,4-cyclohexanedimethanol, dipropylene glycol, polyethylene glycol, polypropylene glycol, and polytetramethylene glycol.

Examples of preferable bisphenols include bisphenol A, hydrogenated bisphenol A, bisphenol A ethylene oxide adduct, and bisphenol A propylene oxide adduct.

Examples of preferable tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of preferable dibasic carboxylic acids include aromatic dicarboxylic acids (specific examples include phthalic acid, terephthalic acid, and isophthalic acid), α,ω-alkanedicarboxylic acids (specific examples include malonic acid, succinic acid, adipic acid, suberic acid, azelaic acid, sebacic acid, and 1,10-decanedicarboxylic acid), alkyl succinic acids (specific examples include n-butylsuccinic acid, isobutylsuccinic acid, n-octylsuccinic acid, n-dodecylsuccinic acid, and isododecylsuccinic acid), alkenyl succinic acids (specific examples include n-butenylsuccinic acid, isobutenylsuccinic acid, n-octenylsuccinic acid, n-dodecenylsuccinic acid, and isododecenylsuccinic acid), maleic acid, fumaric acid, citraconic acid, itaconic acid, glutaconic acid, and cyclohexanedicarboxylic acid.

Examples of preferable tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

A polyester resin having a glass transition point (Tg) of at least 40° C. and no greater than 55° C. and a softening point (Tm) of at least 80° C. and no greater than 110° C. is particularly preferable as the binder resin. A polyester resin including as an alcohol component a bisphenol (for example, either or both a bisphenol A ethylene oxide adduct and a bisphenol A propylene oxide adduct) is preferable as the polyester resin having a glass transition point (Tg) of at least 40° C. and no greater than 55° C. and a softening point (Tm) of at least 80° C. and no greater than 110° C.

The toner cores preferably contain a polyester resin having an acid value of at least 20 mgKOH/g and no greater than 60 mgKOH/g and a hydroxyl value of at least 20 mgKOH/g and no greater than 60 mgKOH/g in order to improve adhesion between the toner cores and the shell layers (eventually, in order to increase bonding strength therebetween).

(Colorant)

The toner cores may contain a colorant. The colorant can be a commonly known pigment or dye selected to match a color of the toner. The amount of the colorant is preferably at least 1 part by mass and no greater than 20 parts by mass relative to 100 parts by mass of the binder resin in order to obtain a toner suitable for image formation.

The toner cores may contain a black colorant. Carbon black may be used as a black colorant. The black colorant may be a colorant that is adjusted to a black color using a yellow colorant, a magenta colorant, and a cyan colorant.

The toner cores may contain a non-black colorant such as a yellow colorant, a magenta colorant, or a cyan colorant.

At least one compound selected from the group consisting of condensed azo compounds, isoindolinone compounds, anthraquinone compounds, azo metal complexes, methine compounds, and arylamide compounds can for example be used as a yellow colorant. Examples of yellow colorants that can be preferably used include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194), Naphthol Yellow S, Hansa Yellow G, and C.I. Vat Yellow.

At least one compound selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds can for example be used as a magenta colorant. Examples of magenta colorants that can be preferably used include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, or 254).

At least one compound selected from the group consisting of copper phthalocyanine compounds, anthraquinone compounds, and basic dye lake compounds can for example be used as a cyan colorant. Examples of cyan colorants that can be preferably used include C.I. Pigment Blue (1, 7, 15, 15:1, 15:2, 15:3, 15:4, 60, 62, or 66), Phthalocyanine Blue, C.I. Vat Blue, and C.I. Acid Blue.

(Releasing Agent)

The toner cores may contain a releasing agent. The releasing agent is used for example for the purpose to improve fixability or offset resistance of the toner. In order to improve fixability or offset resistance of the toner, the amount of the releasing agent is preferably at least 1 part by mass and no greater than 30 parts by mass relative to 100 parts by mass of the binder resin.

Examples of releasing agents that can be preferably used include: aliphatic hydrocarbon waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon waxes such as polyethylene oxide waxes and block copolymers of polyethylene oxide waxes; plant waxes such as candelilla wax, carnauba wax, Japan wax, jojoba wax, and rice wax; animal waxes such as beeswax, lanolin, and spermaceti; mineral waxes such as ozokerite, ceresin, and petrolatum; waxes having a fatty acid ester as a main component such as montanic acid ester wax and castor wax; and waxes in which a part or all of a fatty acid ester has been deoxidized such as deoxidized carnauba wax. One of the releasing agents listed above may be used independently, or two or more releasing agents listed above may be used in combination.

(Charge Control Agent)

The toner cores may contain a charge control agent. The charge control agent is for example used for the purpose to improve charge stability or a charge rise characteristic of the toner. The charge rise characteristic of the toner is an indicator as to whether the toner can be charged to a specific charge level in a short period of time.

Cationic strength of the toner cores can be increased through the toner cores containing a positively chargeable charge control agent (specific examples include pyridine, nigrosine, and quaternary ammonium salt). However, it is not essential to including a charge control agent in the toner cores if sufficient chargeability of the toner can be ensured without the charge control agent.

(Magnetic Powder)

The toner cores may contain a magnetic powder. Examples of materials of the magnetic powder that can be preferably used include ferromagnetic metals (specific examples include iron, cobalt, nickel, and alloys including at least one of these), ferromagnetic metal oxides (specific examples include ferrite, magnetite, and chromium dioxide), and materials subjected to ferromagnetization (specific examples include carbon materials made ferromagnetic through thermal treatment). Magnetic particles subjected to surface treatment are preferably used as a magnetic powder in order to inhibit elution of metal ions (for example, iron ions) from the magnetic powder. One type of the magnetic powders listed above may be used independently, or two or more types of the magnetic powders listed above may be used in combination.

[Shell Layer]

In order to cause the shell layers to have appropriate surface adsorption force while ensuring sufficient heat-resistant preservability, fixability, and chargeability of the toner, it is particularly preferable that: the shell layers each include a resin film mainly formed from an agglomerated mass of thermally resistant particles having a glass transition point of at least 50° C. and no greater than 100° C.; the thermally resistant particles forming the resin film have a number average roundness of at least 0.55 and no greater than 0.75; the thermally resistant particles contain a resin including at least one repeating unit derived from a styrene-based monomer, a repeating unit having an alcoholic hydroxyl group, and a repeating unit derived from a nitrogen-containing vinyl compound; and a repeating unit having the highest mass ratio among repeating units included in the resin contained in the thermally resistant particles is a repeating unit derived from a styrene-based monomer.

A vinyl compound is a compound having a vinyl group ($CH_2$═CH—) or a substituted vinyl group in which hydrogen is replaced (specific examples include ethylene, propylene, butadiene, vinyl chloride, acrylic acid, methyl acrylate, methacrylic acid, methyl methacrylate, acrylonitrile, and styrene). The vinyl compound can form a macromolecule (resin) through addition polymerization by double bonding of carbons "C═C" included a vinyl group or a substituted vinyl group in which hydrogen is replaced. Examples of preferable nitrogen-containing vinyl compounds for forming the thermally resistant particles include (meth)acryloyl group-containing quaternary ammonium compounds such as (meth)acrylamidealkyl trimethylammonium salts (specific examples include (3-acrylamidopropyl)trimethylammonium chloride) and (meth)acryloyloxyalkyl trimethylammonium salts (specific examples include 2-(methacryloyloxy)ethyl trimethylammonium chloride).

Examples of preferable styrene-based monomers for forming the thermally resistant particles include styrene, methylstyrene, butylstyrene, methoxystyrene, bromostyrene, and chlorostyrene.

Examples of preferable monomers for introducing a repeating unit having an alcoholic hydroxyl group into the thermally resistant particles include (meth)acrylic acid 2-hydroxyalkyl esters. Examples of (meth)acrylic acid 2-hydroxyalkyl esters include 2-hydroxyethyl acrylate (HEA), 2-hydroxypropyl acrylate (HPA), 2-hydroxyethyl methacrylate (HEMA), and 2-hydroxypropyl methacrylate.

In order that the shall layers have appropriate surface adsorption force, the resin constituting the thermally resistant particles preferably includes a repeating unit having an alcoholic hydroxyl group, and particularly preferably includes a repeating unit represented by the following formula (1).

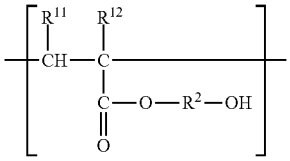

(1)

In formula (1), $R^{11}$ and $R^{12}$ each represent, independently of each other, a hydrogen atom, a halogen atom, or an alkyl group optionally substituted by a substituent. $R^2$ represents an alkylene group optionally substituted by a substituent. Preferably, $R^{11}$ and $R^{12}$ each represent, independently of each other, a hydrogen atom or a methyl group. A combination of $R^{11}$ representing a hydrogen atom and $R^{12}$ representing a hydrogen atom or a methyl group is particularly preferable. $R^2$ is preferably an alkylene group having a carbon number of at least 1 and no greater than 6, and more preferably an alkylene group having a carbon number of at least 1 and no greater than 4. Note that in a repeating unit derived from 2-hydroxyethyl methacrylate (HEMA), $R^{11}$ represents a hydrogen atom, $R^{12}$ represents a methyl group, and $R^2$ represents an ethylene group (—$(CH_2)_2$—).

The resin constituting the thermally resistant particles may further include at least one repeating unit derived from a (meth)acrylic acid alkyl ester in addition to the repeating unit derived from a styrene-based monomer, the repeating unit having an alcoholic hydroxyl group, and the repeating unit derived from a nitrogen-containing vinyl compound. Examples of preferable (meth)acrylic acid alkyl esters include methyl (meth)acrylate, ethyl (meth)acrylate, n-propyl (meth)acrylate, iso-propyl (meth)acrylate, n-butyl (meth)acrylate, and iso-butyl (meth)acrylate.

In order to ensure sufficient heat-resistant preservability, fixability, and chargeability of the toner, the shell layers as above (that is, the resin films mainly formed from agglomerated masses of the thermally resistant particles) preferably have a thickness of at least 10 nm and no greater than 35 nm. The thickness of a shell layer can be measured by analyzing a transmission electron microscope (TEM) image of a section of a toner particle using commercially available image analysis software (for example, "WinROOF" produced by Mitani Corporation). Note that if the thickness of a shell layer is not uniform for a single toner particle, the thickness of the shell layer is measured at each of four locations that are evenly spaced (specifically, four locations at which the shell layer intersects with two orthogonal straight lines intersecting with each other at substantially the center of the cross section of the toner particle) and the arithmetic mean of the four measured values is determined to be an evaluation value (thickness of the shell layer) for the toner particle. A boundary between the toner core and the shell layer can be confirmed for example by selectively dying only the shell layer between the toner core and the shell layer. In a situation in which the boundary between the toner core and the shell layer is unclear in the TEM image, the boundary between the toner core and the shell layer can be clarified by mapping characteristic elements contained in the shell layer in the TEM image using a combination of TEM and electron energy loss spectroscopy (EELS).

In order to ensure sufficient heat-resistant preservability, fixability, and chargeability of the toner, the shell layers as above (that is, the resin films mainly formed from agglomerated masses of the thermally resistant particles) preferably each cover at least 50% and no greater than 80% of a surface area of a toner core. An area ratio of a region of the surface region of the toner core that is covered with the shell layer can be measured by capturing an image of a surface of a toner particle (for example, a toner particle dyed in advance) using an electron microscope and analyzing the captured image using commercially available image analysis software.

[External Additive]

The external additive (specifically, the first resin particles and the second resin particles) is attached to the surfaces of the toner mother particles in the toner having the aforementioned basic features.

The first resin particles and the second resin particles preferably contain, independently of each other, a cross-linked styrene-acrylic acid-based resin, and particularly preferably contain a polymer of monomers (resin raw materials) including a methacrylic acid alkyl ester having at an ester moiety thereof an alkyl group having a carbon number of at least 1 and no greater than 4 (for example, butyl methacrylate having at an ester moiety thereof a butyl group having 4 carbons), a styrene-based monomer (for example, styrene), and a cross-linking agent having at least two unsaturated bonds (for example, divinylbenzene).

The cross-linked styrene-acrylic acid-based resin is a polymer of monomers (resin raw materials) including at least one styrene-based monomer, at least one acrylic acid-based monomer, and a cross-linking agent.

Examples of preferable styrene-based monomers used for forming each of the first resin particles and the second resin particles include styrene, alkyl styrenes (specific examples include α-methylstyrene, o-methylstyrene, m-methylstyrene, p-methylstyrene, ethylstyrene, 2,3-dimethylstyrene, 2,4-dimethylstyrene, o-tert-butylstyrene, m-tert-butylstyrene, and p-tert-butylstyrene), and halogenated styrenes (specific examples include α-chlorostyrene, o-chlorostyrene, m-chlorostyrene, and p-chlorostyrene).

Examples of preferable acrylic acid-based monomers for forming each of the first resin particles and the second resin particles include (meth)acrylic acid, (meth)acrylonitrile, and (meth)acrylic acid alkyl esters. Examples of preferable (meth)acrylic acid alkyl esters include methyl (meth)acrylate, ethyl (meth)acrylate, n-propyl (meth)acrylate, iso-propyl (meth)acrylate, n-butyl (meth)acrylate, iso-butyl (meth) acrylate, and 2-ethylhexyl (meth)acrylate.

The cross-linking agent for forming each of the first resin particles and the second resin particles is preferably a compound having at least two unsaturated bonds, and particularly preferably a monocyclic compound having at least two functional groups each having an unsaturated bond (specific examples include divinylbenzene) or a condensate of one polyhydric alcohol and at least two monobasic carboxylic acids each having a functional group having an unsaturated bond (specific examples include ethylene glycol dimethacrylate and butanediol dimethacrylate). Examples of functional groups having an unsaturated bond include a vinyl group ($CH_2$=CH—) and a substituted vinyl group in which hydrogen is replaced.

In the toner having the aforementioned basic features, the cationic surfactants that are more positively chargeable than corresponding resin particles are present on the surfaces of the first resin particles and the second resin particles. A nitrogen (N)-containing cationic surfactant is preferable as each cationic surfactant. Examples of preferable nitrogen-containing cationic surfactants include quaternary ammonium salt surfactants (specific examples include alkyl trimethylammonium salt, dialkyl dimethylammonium salt, alkylbenzyl dimethylammonium salt, and benzethonium chloride), alkylamine salt surfactants (specific examples include alkylamine acetate and alkylamine hydrochloride), and surfactants having a pyridine ring (specific examples include butylpyridinium chloride and cetylpyridinium chloride). Examples of particularly preferable cationic surfactants include alkyl trimethylammonium salts having an alkyl group having a carbon number of at least 10 and no greater than 25 (for example, cetyltrimethylammonium chloride having an alkyl group having 16 carbons) and alkylamine acetates having an alkyl group having a carbon number of at least 10 and no greater than 25 (for example, stearylamine acetate having an alkyl group having 18 carbons).

Inorganic particles may be attached to the surfaces of the toner mother particles in addition to the first resin particles and the second resin particles. The inorganic particles (external additive) are preferably silica particles or particles of metal oxides (specific examples include alumina, titanium oxide, magnesium oxide, zinc oxide, strontium titanate, and barium titanate), and particularly preferably at least one type of particles selected from the group consisting of silica particles and titanium oxide particles.

The external additive particles may be subjected to surface treatment. In a situation for example in which silica particles are used as the external additive particles, the surfaces of the silica particles may be made hydrophobic and/or positively chargeable with a surface treatment agent. Examples of surface treatment agents that can be preferably used include coupling agents (specific examples include silane coupling agents, titanate coupling agents, and aluminate coupling agents), silazane compounds (specific examples include chain silazane compounds and cyclic silazane compounds), and silicone oils (specific examples include dimethyl silicone oil). A particularly preferable surface treatment agent is a silane coupling agent or a silazane compound. Examples of preferable silane coupling agents include silane compounds (specific examples include methyltrimethoxysilane and aminosilane). A preferable example of silazane compounds is hexamethyldisilazane (HMDS).

When a surface of a silica base (untreated silica particles) is subjected to surface treatment with a surface treatment agent, some or all of a number of hydroxyl groups (—OH) present on the surface of the silica base are replaced by functional groups derived from the surface treatment agent. As a result of replacement, silica particles can be obtained that have the functional groups derived from the surface treatment agent (specifically, functional groups more hydrophobic and/or more positively chargeable than a hydroxyl group) on surfaces thereof. For example, when the surface of the silica base is subjected to surface treatment with a silane coupling agent having an amino group, a hydroxyl group in the silane coupling agent (for example, a hydroxyl group generated through hydrolysis of an alkoxy group in the silane coupling agent by moisture) causes dehydration condensation with a hydroxyl group present on the surface of the silica base ("A (silica base)-OH"+"B (coupling agent)-OH→"A-O—B"+$H_2O$). The silane coupling agent having an amino group and silica are chemically bonded to each other through a reaction such as above to provide the amino group to the surfaces of the silica particles, thereby obtaining positively chargeable silica particles. More specifically, the hydroxyl group present on the surface of the silica base is replaced by a functional group having an amino group at an end thereof (more specifically, —O—Si—$(CH_2)_3$—$NH_2$, for example). The silica particles to which the amino group is provided tend to be more positively chargeable than the silica base (untreated silica particles). When a silane coupling agent having an alkyl group is alternatively used, hydrophobic silica particles are obtained. More specifically, the hydroxyl group present on the surface of the silica base can be replaced by a functional group having an alkyl group at an end thereof (more specifically, —O—Si—$CH_3$, for example) through dehydration condensation as above. The silica particles to which a hydrophobic group (for example, an alkyl group having a carbon number of at least 1 and no greater than 3) is provided rather than a hydrophilic group (hydroxyl group) as described above tend to be more hydrophobic than the silica base (untreated silica particles).

Inorganic particles each including a conductive layer on a surface thereof may be used as external additive particles. The conductive layer is a layer of a metal oxide made conductive for example through doping (specific examples include a Sb-doped $SnO_2$ layer). The metal oxide may be also referred to below as a "doped metal oxide". Alternatively, the conductive layer may be a layer containing a conductive material other than the doped metal oxide (specific examples include metals, carbon materials, and conductive macromolecules). For example, external additive particles having low electric resistance (conductive titanium oxide particles) can be obtained by forming the conductive layer on a surface of a titanium oxide base (untreated titanium oxide particles).

[Toner Production]

The following describes a preferable example of methods for producing the toner having the aforementioned basic features. First, the toner mother particles, the first resin particles, and the second resin particles are prepared.

(Preparation of Toner Mother Particles)

Capsule toner mother particles are obtained by preparing toner cores and forming shell layers on surfaces of the toner cores, as described below. However, the toner cores may be directly used as non-capsule toner mother particles without undergoing shell layer formation. In the following description, a material for forming shell layers will be referred to as a "shell material".

The toner cores can be produced for example by a pulverization method or an aggregation method. The above methods can facilitate favorable dispersion of an internal additive in a binder resin of the toner cores. Typically, toner cores are roughly divided into pulverized cores (also called as a pulverized toner) and polymerized cores (also called a chemical toner). Toner cores obtained by a pulverization method belong to pulverized cores, while toner cores obtained by an aggregation method belong to polymerized cores. In a situation in which the toner mother particles in the aforementioned basic features are capsule toner mother particles, the toner cores of the capsule toner mother particles are preferably pulverized cores containing a polyester resin.

In an example of pulverization methods, a binder resin, a colorant, a charge control agent, and a releasing agent are mixed together. Subsequently, a resultant mixture is melt-kneaded using a melt-kneader (for example, a single or twin screw extruder). The resultant melt-kneaded product is then pulverized, and the resultant pulverized product is classified. Through the above, toner cores having a desired particle diameter are obtained.

In an example of aggregation methods, fine particles of a binder resin, a releasing agent, a charge control agent, and a colorant are caused to aggregate in an aqueous medium containing these fine particles until particles having a desired diameter are obtained. As a result, aggregated particles containing the binder resin, the releasing agent, the charge control agent, and the colorant are formed. Subsequently, the obtained aggregated particles are heated to coalesce components contained in the aggregated particles. Through the above, toner cores having a desired particle diameter are obtained.

Examples of shell layer formation methods include in-situ polymerization, in-liquid curing film coating process, and coacervation. More specifically, a method is preferable by which shell layers are formed on the surfaces of the toner cores in a manner that the toner cores are put into an aqueous medium in which a water-soluble shell material is dissolved and the aqueous medium is heated to cause polymerization reaction of the shell material to proceed (first shell layer formation method).

Resin particles (for example, resin dispersion) may be used as a shell material in shell layer formation. More specifically, a method is preferable by which shell layers are formed on the surfaces of the toner cores in a manner that resin particles are attached to the surfaces of the toner cores in a liquid (for example, an aqueous medium) including the resin particles and the toner cores and the liquid is heated to cause formation of films of the resin particles to proceed (second shell layer formation method). Bonding among the resin particles on the surfaces of the toner cores (eventually, cross-linking reaction in the respective resin particles) can be caused to proceed during the liquid being kept at high temperature. Furthermore, formation of films of the resin particles present on the surfaces of the toner cores may be caused to proceed by applying physical impact force to the toner cores having surfaces to which the resin particles are attached.

The aqueous medium is a medium containing water as a main component (specific examples include pure water and a mixed liquid of water and a polar medium). An alcohol (specific examples include methanol and ethanol) can for example be used as a polar medium in the aqueous medium. The aqueous medium has a boiling point of approximately 100° C.

(Preparation of Resin Particles)

For example, when a polymerization reaction for forming the first resin particles (polymerization of a resin raw material) is caused in a liquid including a material of the first resin particles (resin raw material) and a cationic surfactant and the first resin particles collected from the liquid are not washed (or, the cationic surfactant present on the surfaces of the first resin particles is not completely removed in washing), the cationic surfactant can be allowed to be present on the surfaces of the first resin particles. The cationic surfactant is attached to the surfaces of the first resin particles. Also, when the first resin particles are changed to the second resin particles in the above method, the cationic surfactant can be allowed to be present on the surfaces of the second resin particles. The number average primary particle diameter of resin particles can be adjusted by changing conditions of stirring in formation of the resin particles (for example, stirring speed) or the amount of the surfactant.

(External Additive Addition)

When the toner mother particles, the first resin particles, and the second resin particles obtained as above are mixed together, the first resin particles and the second resin particles can be attached to the surfaces of the toner mother particles. Another external additive (for example, silica particles) may be mixed with the toner mother particles in addition to the first resin particles and the second resin particles.

Unlike an internal additive, an external additive is not present within a toner mother particle, but is selectively present on a surface of the toner mother particle (a surface layer portion of the toner particle). External additive particles can be attached to the surfaces of the toner mother particles by stirring the toner mother particles and the external additive together. The external additive particles do not chemically react with the toner mother particle and are connected thereto physically rather than chemically. Connection strength between the toner mother particle and the external additive particles can be adjusted by controlling for example conditions of stirring (more specifically, a stirring time, a rotational speed for stirring, and the like) and particle diameter, shape, and surface conditions of the external additive particles.

EXAMPLES

Examples of the present disclosure will be described below. Table 1 shows toners TA-1 to TA-9 and TB-1 to TB-9 (positively chargeable toners) according to Examples and Comparative Examples. Table 2 shows external additives (resin particles SA-1 to SA-7 and SB-1 to SB-5) each used in production of a corresponding one of the toners shown in Table 1.

TABLE 1

| | External additive | | | |
|---|---|---|---|---|
| | First external additive | | Second external additive | |
| Toner | Type | Coverage ratio [%] | Type | Coverage ratio [%] |
| TA-1 | SA-1 | 15 | SB-1 | 18 |
| TA-2 | SA-1 | 12 | SB-1 | 13 |
| TA-3 | SA-1 | 26 | SB-1 | 25 |
| TA-4 | SA-1 | 25 | SB-1 | 15 |
| TA-5 | SA-2 | 29 | SB-1 | 12 |
| TA-6 | SA-1 | 17 | SB-2 | 18 |
| TA-7 | SA-2 | 13 | SB-2 | 28 |
| TA-8 | SA-6 | 16 | SB-1 | 19 |
| TA-9 | SA-7 | 18 | SB-1 | 20 |
| TB-1 | SA-3 | 28 | SB-1 | 21 |
| TB-2 | SA-4 | 20 | SB-1 | 28 |
| TB-3 | SA-2 | 18 | SB-3 | 20 |
| TB-4 | SA-1 | 15 | SB-4 | 27 |
| TB-5 | SA-5 | 20 | SB-5 | 22 |
| TB-6 | SA-1 | 27 | None | — |
| TB-7 | SB-1 | 28 | None | — |
| TB-8 | SA-1 | 52 | SB-1 | 18 |
| TB-9 | SA-1 | 18 | SB-1 | 51 |

Items representing respective external additives in Table 1 are as follows.

SA-1 to SA-7: resin particles SA-1 to SA-7, respectively, shown in Table 2 below.

SB-1 to SB-5: resin particles SB-1 to SB-5, respectively, shown in Table 2 below.

TABLE 2

| Resin particles | Monomer MMA [g] | BMA [g] | S [g] | HEMA [g] | Cross-linking agent DVB [g] | Surfactant DTAC [g] | AE [g] | Particle diameter [nm] | M.W. [%] | BL rate [%] |
|---|---|---|---|---|---|---|---|---|---|---|
| SA-1 | 80 | 0 | 80 | 0 | 40 | 3.00 | 0.00 | 65 | 28 | 22 |
| SA-2 | 0 | 80 | 80 | 0 | 40 | 5.00 | 2.50 | 35 | 21 | 20 |
| SA-3 | 80 | 0 | 70 | 5 | 40 | 10.0 | 0.00 | 40 | 5 | 18 |
| SA-4 | 80 | 0 | 80 | 0 | 40 | 3.0 | 0.00 | 63 | 50 | 20 |
| SA-5 | 0 | 80 | 60 | 0 | 5 | 4.00 | 2.50 | 45 | 28 | 60 |
| SA-6 | 80 | 0 | 80 | 0 | 50 | 3.00 | 0.00 | 63 | 25 | 10 |
| SA-7 | 80 | 0 | 80 | 0 | 40 | 4.00 | 0.00 | 50 | 25 | 21 |
| SB-1 | 0 | 80 | 80 | 0 | 40 | 0.80 | 0.80 | 80 | 52 | 24 |
| SB-2 | 0 | 80 | 80 | 0 | 40 | 0.30 | 0.30 | 115 | 65 | 21 |
| SB-3 | 0 | 80 | 80 | 0 | 40 | 1.00 | 1.00 | 83 | 20 | 23 |
| SB-4 | 0 | 80 | 80 | 0 | 40 | 0.15 | 0.15 | 145 | 72 | 22 |
| SB-5 | 80 | 0 | 60 | 0 | 5 | 0.30 | 0.30 | 110 | 54 | 72 |

Items representing resin raw materials in Table 2 are as follows.

(Monomer)

MMA: methyl methacrylate.

BMA: n-butyl methacrylate.

S: styrene.

HEMA: 2-hydroxyethyl methacrylate.

(Cross-Linking Agent)

DVB: divinylbenzene.

(Surfactant)

DTAC: dodecyltrimethylammonium chloride.

AE: polyoxyethylene lauryl ether.

"Particle diameter (unit: nm)" in Table 2 indicates a number average primary particle diameter.

"M.W. (unit: %)" in Table 2 indicates MW hydrophobicity (specifically, hydrophobicity measured by the methanol wettability method).

"BL rate (unit: %)" in Table 2 indicates a blocking rate as measured using a mesh having an opening size of 75 μm after 5-minute application of a pressure of 0.1 kgf/mm$^2$ at a temperature of 160° C.

The following describes production methods, evaluation methods, and evaluation results for the toners TA-1 to TA-9 and TB-1 to TB-9 in order. In evaluations in which errors may occur, an evaluation value was calculated by calculating the arithmetic mean of an appropriate number of measured values in order to ensure that any error was sufficiently small.

[Material Preparation]

(Preparation of Toner Cores)

A polyester resin having a hydroxyl value (OHV) of 20 mgKOH/g, an acid value (AV) of 40 mgKOH/g, a softening point (Tm) of 100° C., and a glass transition point (Tg) of 48° C. was obtained by causing a reaction between a bisphenol A ethylene oxide adduct (specifically, an alcohol produced through addition of ethylene oxide to a bisphenol A framework) and an acid having a polyfunctional group (more specifically, terephthalic acid).

An FM mixer (product of Nippon Coke & Engineering Co., Ltd.) was used to mix 100 parts by mass of the polyester resin obtained as above, 5 parts by mass of a colorant (C.I. Pigment Blue 15:3, component: copper phthalocyanine pigment), and 5 parts by mass of an ester wax ("NISSAN ELECTOL (registered Japanese trademark) WEP-3", product of NOF Corporation).

Subsequently, the resultant mixture was melt-kneaded using a twin-screw extruder ("PCM-30", product of Ikegai Corp.). The resultant melt-kneaded product was then roll under cooling, and then pulverized using a pulverizer ("Turbo Mill", product of FREUND-TURBO CORPORATION). The resultant pulverized product was classified using a classifier ("Elbow Jet Type EJ-LABO", product of Nittetsu Mining Co., Ltd.). Through the above, toner cores were obtained that have a volume median diameter ($D_{50}$) of 6 μm, a roundness of 0.93, a glass transition point (Tg) of 49° C., and a softening point (Tm) of 92° C.

(Shell Material: Preparation of Suspension of Resin Fine Particles)

A 1-L three-necked flask equipped with a thermometer and a stirring impeller was set in a water bath set at a temperature of 30° C. The flask was then charged with 875 mL of ion exchanged water and 75 mL of an anionic surfactant ("LATEMUL (registered Japanese trademark) WX", product of Kao Corporation, component: sodium polyoxyethylene alkyl ether sulfate, solid concentration: 26% by mass). Thereafter, the internal temperature of the flask was increased to 80° C. using the water bath. Subsequently, two liquids (a first liquid and a second liquid) were separately dripped into the flask contents at 80° C. over 5 hours at a specific rate. The first liquid was a mixed liquid of 18 g of styrene, 2 g of n-butyl acrylate, 2 mL of 2-hydroxyethyl methacrylate (HEMA), and 0.5 g of 2-(methacryloyloxy)ethyl trimethylammonium chloride (product of Alfa Aesar). The second liquid was a solution obtained by dissolving 0.5 g of potassium persulfate in 30 mL of ion exchanged water. Next, polymerization of the flask contents was caused by keeping the internal temperature of the flask at 80° C. for further 2 hours. As a result, a suspension of resin fine particles was obtained. The obtained suspension included resin fine particles having a number average primary particle diameter of 35 nm and a glass transition point (Tg) of 74° C. The number average primary particle diameter was measured using a transmission electron microscope (TEM).

(External Additive: Production of Resin Particles SA-1 to SA-7 and SB-1 to SB-5)

With respect to each of the resin particles SA-1 to SA-7 and SB-1 to SB-5, 600 g of ion exchanged water, 15 g of a polymerization initiator (BPO: benzoyl peroxide), and corresponding materials of types and amounts shown in Table 2 were added into a 1-L four-necked flask equipped with a stirrer, a cooling pipe, a thermometer, and a nitrogen inlet tube. In preparation of for example the resin particles SA-1, 80 g of methyl methacrylate (MMA), 80 g of styrene (S), 40 g of a cross-linking agent (DVB: divinylbenzene), and 3 g of a cationic surfactant (DTAC: dodecyltrimethylammonium chloride) were added into the flask. Note that divinylbenzene (DVB) used as a cross-linking agent in preparation of each of the resin particles SA-1 to SA-7 and SB-1 to SB-5 had a purity (mass fraction) of 80%.

Next, the internal atmosphere of the flask was changed to a nitrogen atmosphere by introducing nitrogen gas into the flask while the flask contents were stirred. The temperature of the flask contents was increased to 90° C. in the nitrogen atmosphere while the flask contents were stirred. A reaction (specifically, polymerization reaction) of the flask contents was caused for 3 hours in the nitrogen atmosphere at a temperature of 90° C. to obtain an emulsion including a reaction product. Subsequently, the resultant emulsion was cooled, and then dewatered to obtain the resin particles SA-1 to SA-7 and SB-1 to SB-5. The particle diameter of each of the resin particles SA-1 to SA-7 and SB-1 to SB-5 was adjusted by changing conditions of stirring in the polymerization reaction. Specifically, the number average primary particle diameter of the resultant resin particles tended to decrease as the rotational speed of the stirring impeller was increased. Each of the resin particles SA-1 to SA-7 and SB-1 to SB-5 was substantially constituted by a cross-linked styrene-acrylic acid-based resin. The resin particles SA-1 to SA-7 and SB-1 to SB-5 obtained as above were not washed and directly used in an external additive addition process.

With respect to each type of the resin particles SA-1 to SA-7 and SB-1 to SB-5 obtained as above, a number average primary particle diameter, a BL rate (specifically, a blocking rate as measured using a mesh having an opening size of 75 μm after 5-minute application of a pressure of 0.1 kgf/mm$^2$ at a temperature of 160° C.), and a MW hydrophobicity (specifically, a hydrophobicity measured by the methanol wettability method) were measured, results of which are shown in Table 2. For example, the resin particles SA-1 had a number average primary particle diameter of 65 nm, a BL rate of 22%, and a MW hydrophobicity of 28%. Each type of the resin particles SA-1 to SA-7 and SB-1 to SB-5 had a sharp particle size distribution. Specifically, each external additive included at least 80% by number of primary particles having a particle diameter of at least "a number average primary particle diameter minus 5 nm" and no greater than "the number average primary particle diameter plus 5 nm". The number average primary particle diameter was measured using a dynamic light scattering particle diameter measurement device ("FPAR-1000", product of Otsuka Electronics Co., Ltd., light source: semiconductor laser, detector: photo multiplier tube (PMT), temperature adjusting method: method using an electronic cooling element and a heater). The BL rate and the MW hydrophobicity were measured as follows.

<BL Rate Measuring Method>

A device (product of KYOCERA Document Solutions Inc.) including a table (material: SUS304) with a cylindrical hole (diameter: 10 mm, depth: 10 mm), a cylindrical indenter (diameter: 10 mm, material: SUS304), and a heater was used as a measurement jig. Note that SUS304 is an iron-chromium-nickel alloy (austenite stainless steel) having a nickel content of 8% by mass and a chromium content of 18% by mass.

In an environment at a temperature of 23° C. and a relative humidity of 50%, 10 mg of the resin particles (measurement target: any type of the resin particles SA-1 to SA-7 and SB-1 to SB-5) was charged into the hole (measurement portion) of the jig. The measurement portion was heated to 160° C. using the heater of the jig, and a pressure of 0.1 kgf/mm$^2$ was applied to the measurement portion (eventually, the resin particles in the measurement portion) for 5 minutes using the indenter (load: approximately 100 N) of the jig. Thereafter, the resin particles in the measurement portion (specifically, in the hole) were all collected and placed on a mesh having an opening size of 75 μm and a known mass (200-mesh sieve defined in JIS Z8801-1 and having a wire diameter of 50 μm and plain-weave square mesh openings). The mass of the sieve including the resin particles was measured to obtain a mass of the resin particles on the sieve (mass of resin particles before suction).

Subsequently, the resin particles on the sieve were sucked from below the sieve using a suction device ("V-3SDR", product of AMANO Corporation). By the above suction, only non-agglomerated resin particles among the resin particles on the sieve passed through the sieve. After the suction, a mass of resin particles (mass of resin particles after suction) not having passed through the sieve (resin particles remaining on the sieve) was measured. A BL rate (unit: % by mass) was calculated from the mass of the resin particles before suction and the mass of the resin particle after suction based on the following equation.

$$BL\ \text{rate}=100\times(\text{mass of resin particles after suction})/(\text{mass of resin particles before suction})$$

<MW Hydrophobicity Measuring Method>

The MW hydrophobicity of the resin particles was measured by the methanol wettability method (MW method). Specifically, 0.1 g of resin particles (measurement target: any type of the resin particles SA-1 to SA-7 and SB-1 to SB-5) was added into a glass beaker charged with 25 mL of ion exchanged water. Methanol was dripped into the beaker little by little while the beaker contents were stirred using a magnetic stirrer at a rotational speed of 150 rpm. An amount Vm (unit: mL) of dripped methanol was measured when the resin particles were all wet and precipitated (that is, complete precipitation). The MW hydrophobicity (unit: %) of the resin particles was calculated based on the following equation. For example, when an amount Vm of dripped methanol at complete precipitation of the resin particles is 25 mL, the resin particles have a MW hydrophobicity of 50%.

$$MW\ \text{hydrophobicity}=100\times Vm/(Vm+25)$$

Note that although the above shows examples of values measured before external additive addition, the same results as those shown in Table 2 were obtained even when a BL rate and a MW hydrophobicity were measured for resin particles (external additive) separated from the mother particles after external additive addition. The external additive can be separated from the mother particles using an ultrasonic disperser ("Ultrasonic Mini Welder P128", product of Ultrasonic Engineering Co., Ltd., output: 100 W, oscillation frequency: 28 kHz). The external additive separated from the mother particles can be collected by suction filtration. In a situation in which the collected external additive includes inorganic particles in addition to the resin particles, these particles can be separated from each other using a centrifuge. Specifically, when centrifugation is performed on a dispersion of an external additive including resin particles and inorganic particles, only the inorganic particles heavier (higher in density) than the resin particles precipitate and a supernatant including the resin particles is obtained. The resin particles can be collected from the supernatant through pressure filtration.

[Toner Production]

(Shell Layer Formation Process)

A 1-L three-necked flask equipped with a thermometer and a stirring impeller was prepared, and the flask was set in a water bath. Subsequently, 300 mL of ion exchanged water was added into the flask and the internal temperature of the flask was kept at 30° C. using the water bath. The flask contents were then adjusted to have a pH of 4 by adding dilute hydrochloric acid into the flask.

Next, 220 g of the shell material (a suspension of the resin fine particles prepared through the above procedure) was added into the flask and 300 g of the toner cores (toner cores prepared through the above procedure) were further added into the flask. Subsequently, the flask contents were stirred for 60 minutes under conditions of a rotational speed of 200 rpm and a temperature of 30° C. Then, 300 mL of ion exchanged water was added into the flask. The internal temperature of the flask was increased up to 70° C. at a rate of 1.0° C./minute while the flask contents were stirred at a rotational speed (stirring impeller) of 100 rpm, and then the flask contents were stirred for 2 hours under conditions of a temperature of 70° C. and a rotational speed (stirring impeller) of 100 rpm. As a result, a dispersion of toner mother particles before being subjected to later-described mechanical treatment (also referred to below as "pre-treatment particles") was obtained. Thereafter, the dispersion of the pre-treatment particles was adjusted to have a pH of 7 (neutralized) using sodium hydroxide, and then cooled to normal temperature (approximately 25° C.).

(Washing Process)

The dispersion of the pre-treatment particles obtained as above was filtered (solid-liquid separation) using a Buchner funnel. As a result, a wet cake of the pre-treatment particles was collected. The collected wet cake of the pre-treatment particles was then re-dispersed in ion exchanged water. Dispersion and filtration were repeated 5 times in total to wash the pre-treatment particles.

(Drying Process)

Next, the washed pre-treatment particles were dispersed in an ethanol solution at a concentration of 50% by mass to obtain a slurry of the pre-treatment particles. The pre-treatment particles in the slurry were dried using a continuous surface-modifying apparatus ("COATMIZER (registered Japanese trademark)", product of Freund Corporation) under conditions of a hot air temperature of 45° C. and a blower flow rate of 2 $m^3$/minute. As a result, dry pre-treatment particles were obtained.

(Mechanical Treatment)

Subsequently, mechanical treatment (specifically, treatment for applying shear force) was performed on the pre-treatment particles for 10 minutes using a fluidized mixer ("FM-20C/I", product of Nippon Coke & Engineering Co., Ltd.) udder conditions of a rotational speed of 3,000 rpm and a jacket temperature of 20° C. When physical force was applied to the resin particles present on the surfaces of the toner cores, the resin particles receiving the physical force deformed to be connected to one another by the physical force. The mechanical treatment made an agglomerated mass of the resin particles into a film on the surface of each of the toner cores. As a result, resin films were formed that each were substantially formed from resin particles (each being a cross-linked styrene-acrylic acid-based resin particle) having a number average roundness of at least 0.55 and no greater than 0.75. Through the mechanical treatment on the pre-treatment particles, toner mother particles were obtained.

(External Additive Addition Process)

The toner mother particles obtained as above, hydrophobic silica particles ("AEROSIL (registered Japanese trademark) RA-200H", product of Nippon Aerosil Co., Ltd., content: dry silica particles surface-modified with a trimethylsilyl group and an amino group, number average primary particle diameter: approximately 12 nm), conductive titanium oxide particles ("EC-100", product of Titan Kogyo, Ltd., base: $TiO_2$ particles, coat layer: Sb-doped $SnO_2$ layer), and resin particles shown in Table 1 (at least one type of resin particles selected from the group consisting of the resin particles SA-1 to SA-7 and SB-1 to SB-5 produced by the above-described procedure) were loaded into an FM mixer ("FM-10B", product of Nippon Coke & Engineering Co., Ltd.). Then, 5-minute mixing was performed using the FM mixer under conditions of a rotational speed of 3,000 rpm and a jacket temperature of 20° C. The amount of the hydrophobic silica particles was 1.2 parts by mass and the amount of the conductive titanium oxide particles was 1.5 parts by mass, relative to 100 parts by mass of the toner mother particles. The amount of the resin particles was determined so as to attain a value for the coverage ratio shown in Table 1. The larger the amount of the external additive is, the larger the coverage ratio with the external additive tends to be. In production of for example the toner TA-1, the resin particles SA-1 were added in an amount to attain a coverage ratio with the resin particles SA-1 of 15% and the resin particles SB-1 were added in an amount to attain a coverage ratio with the resin particles SB-1 of 18%.

Through the above external additive addition process, the external additive was attached to the surfaces of the toner mother particles. Thereafter, sifting was performed using a 200-mesh sieve (opening size: 75 μm). Through the above, a toner (each of the toners TA-1 to TA-9 and TB-1 to TB-9) including a number of toner particles was obtained.

Coverage ratios with corresponding external additives were measured with respect to each of the toners TA-1 to TA-9 and TB-1 to TB-9 obtained as above, results of which are as shown in Table 1. For example, the toner TA-1 had a coverage ratio with the resin particles SA-1 of 15% and a coverage ratio with the resin particles SB-1 of 18%. These coverage ratios were measured as follows.

<Coverage Ratio Measuring Method>

An external additive coverage ratio was measured through observation of a surface of a toner particle using a scanning electron microscope (SEM). Specifically, an external additive coverage ratio was obtained through image analysis using image analysis software ("WinROOF", product of Mitani Corporation) on a backscattered electron image (surface image) of a toner particle captured using a field effect scanning electron microscope (FE-SEM). With respect to a portion of a surface of a toner mother particle where plural types of external additive particles were present in an overlapping manner, it was determined that an outermost external additive particle (specifically, an external additive particle present on the highest level relative to the surface of the toner mother particle) covered the portion. For example, it was determined that a portion of the surface of the toner mother particle where a first resin particle and a second resin particle overlapped in the stated order from the surface of the toner mother particle was covered with the outermost second resin particle. A coverage ratio of each of 10 locations of a single toner particle was visually measured, and an arithmetic mean of the thus obtained 10 measured values was determined to be an evaluation value (coverage ratio) of the toner particle. Furthermore, coverage ratios of respective 10 toner particles included in a measurement target (toner) were measured and an arithmetic mean of the obtained 10 measured values was determined to be an evaluation value (coverage ratio) of the measurement target (toner).

[Evaluation Methods]

Samples (toners TA-1 to TA-9 and TB-1 to TB-9) were evaluated according to the following evaluation methods.

(Preparation of Evaluation Developer)

An evaluation developer (two-component developer) was obtained by mixing 100 parts by mass of a developer carrier (carrier for "TASKalfa 5550ci" produced by KYOCERA Document Solutions Inc.) and 10 parts by mass of a toner (evaluation target: any of the toners TA-1 to TA-9 and TB-1 to TB-9) for 30 minutes using a ball mill.

(Thermal-Stress Resistance)

The evaluation developer (two-component developer) prepared through the above-described procedure was loaded in a development device taken out of a multifunction peripheral ("TASKalfa 500ci", product of KYOCERA Document Solutions Inc.). The development device was left to stand in a thermostatic chamber set at 50° C. for one hour. Thereafter, aging was performed by driving the development device taken out of the thermostatic chamber for one hour by an external motor. The driving condition (specifically, rotational speed) was set to be the same as that in driving the development device in the multifunction peripheral (TASKalfa 500ci).

After the aging, the developer (two-component developer) was collected from the development device. Then, 10 g of the collected developer was placed on a 200-mesh sieve (opening size: 75 μm) having a known mass. A mass of the sieve on which the developer was placed was measured to calculate a mass of the developer on the sieve (mass of developer before sifting). Next, the sieve on which the developer was placed was shaken in a powder characteristic evaluation device ("POWDER TESTER (registered Japanese trademark)", product of Hosokawa Micron Corporation) in accordance with a manual of the evaluation device for 60 seconds at a rheostat level of 5. A mass of the sieve including the developer on the sieve was measured after the sifting to calculate a mass of developer remaining on the sieve (mass of developer after sifting). An aggregation rate of the developer (unit: % by mass) was calculated based on the following equation.

$$\text{Aggregation rate}=100\times(\text{mass of developer after sifting})/(\text{mass of developer before shifting})$$

An aggregation rate of no greater than 2.0% by mass was evaluated as good, and an aggregation rate of greater than 2.0% by mass was evaluated as poor.

(Measurement of Initial Charge Amount $E_A$)

Directly after the preparation of the evaluation developer through the above-described procedure, an amount of charge (unit: μC/g) of the toner included in the prepared evaluation developer was measured using a Q/m meter ("MODEL 210HS", product of TREK, INC.). In the following description, an amount of charge measured at that time point will be referred to as an "initial charge amount $E_A$" (or simply "$E_A$").

(Charge Retention Rate After Printing Durability Test at High Printing Rate>

The evaluation developer prepared through the above-described procedure was loaded in a multifunction peripheral ("TASKalfa 500ci", product of KYOCERA Document Solutions Inc.). An image having a printing rate of 20% was output 4,000 times in an environment at a temperature of 23° C. and a relative humidity of 50% using the multifunction peripheral while a toner for replenishment use (evaluation target: any of the toners TA-1 to TA-9 and TB1 to TB-9) was supplied. Thereafter, a development device was taken out of the multifunction peripheral and two-component developer was collected from the development device. An amount of charge (unit: μC/g) of toner included in the collected two-component developer was measured using a Q/m meter ("MODEL 210HS", product of TREK, INC.). In the following description, an amount of charge measured at that time point will be referred to as a "post-printing charge amount $E_B$" (or simply "$E_B$").

A charge retention rate after the printing durability test at a high printing rate (also referred to below as an "actual charge retention rate") was calculated from the initial charge amount $E_A$ and the post-printing charge amount $E_B$, each of which was obtained as described above, based on the following equation.

$$\text{Actual charge retention rate}=100\times E_B/E_A$$

An actual charge retention rate of at least 70% and no greater than 100% was evaluated as good, and an actual charge retention rate of less than 70% was evaluated as poor.

(Charge Retention Rate After Printing Durability Test in Low-Humidity Environment)

The evaluation developer prepared through the above-described procedure was loaded in a multifunction peripheral ("TASKalfa 500ci", product of KYOCERA Document Solutions Inc.). An image having a printing rate of 2% was output 4,000 times in an environment at a temperature of 10° C. and a relative humidity of 10% using the multifunction peripheral while a toner for replenishment use (evaluation target: any of the toners TA-1 to TA-9 and TB1 to TB-9) was supplied. Thereafter, a development device was taken out of the multifunction peripheral and two-component developer was collected from the development device. An amount of charge (unit: μC/g) of toner included in the collected two-component developer was measured using a Q/m meter ("MODEL 210HS", product of TREK, INC.). In the following description, an amount of charge measured at that time point will be referred to as a "post-printing charge amount $E_C$" (or simply "$E_C$").

A charge retention rate after the printing durability test in a low-humidity environment (also referred to below as a "low-humidity charge retention rate") was calculated from the initial charge amount $E_A$ and the post-printing charge amount $E_C$, each of which was obtained as described above, based on the following equation.

$$\text{Low-humidity charge retention rate}=100\times E_C/E_A$$

A low-humidity charge retention rate of at least 100% and no greater than 130% was evaluated as good, and a low-humidity charge retention rate of greater than 130% was evaluated as poor.

(Charge Retention Rate After Printing Durability Test in High-Humidity Environment)

The evaluation developer prepared through the above-described procedure was loaded in a multifunction peripheral ("TASKalfa 500ci", product of KYOCERA Document Solutions Inc.). An image having a printing rate of 5% was output 1,000 times in an environment at a temperature of 23° C. and a relative humidity of 50% using the multifunction peripheral while a toner for replenishment use (evaluation target: any of the toners TA-1 to TA-9 and TB-1 to TB-9) was supplied. Thereafter, a development device was taken out of the multifunction peripheral and two-component developer was collected from the development device. An amount of charge (unit: μC/g) of toner included in the collected two-component developer was measured using a Q/m meter ("MODEL 210HS", product of TREK, INC.). In the following description, an amount of charge measured at that time point will be referred to as a "post-printing charge amount $E_D$" (or simply "$E_D$").

Subsequently, an image having a printing rate of 5% was output 1,000 times in an environment at a temperature of 32.5° C. and a relative humidity of 80% using the multifunction peripheral while a toner for replenishment use (evaluation target: any of the toners TA-1 to TA-9 and TB-1 to TB-9) was supplied. Thereafter, a development device was taken out of the multifunction peripheral and two-component developer was collected from the development device. An amount of charge (unit: μC/g) of toner included in the collected two-component developer was measured using a Q/m meter ("MODEL 210HS", product of TREK, INC.). In the following description, an amount of charge measured at that time point will be referred to as a "post-printing charge amount $E_E$" (or simply "$E_E$").

A charge retention rate after the printing durability test in a high-humidity environment (also referred to below as a "high-humidity charge retention rate") was calculated from the post-printing charge amount $E_D$ and the post-printing charge amount $E_E$, each of which was obtained as described above, based on the following equation.

$$\text{High-humidity charge retention rate}=100\times E_E/E_D$$

A high-humidity charge retention rate of at least 50% and no greater than 100% was evaluated as good, and a high-humidity charge retention rate of less than 50% was evaluated as poor.

(Anti-Fogging Property)

The evaluation developer prepared through the above-described procedure was loaded in a multifunction peripheral ("TASKalfa 500ci", product of KYOCERA Document Solutions Inc.). An image having a printing rate of 5% was output 4,000 times in an environment at a temperature of 10° C. and a relative humidity of 10% using the multifunction peripheral while a toner for replenishment use (evaluation target: any of the toners TA-1 to TA-9 and TB-1 to TB-9) was supplied. Subsequently, an image having a printing rate of 20% was output 500 times in the same environment (i.e., temperature 10° C., relative humidity 10%) using the multifunction peripheral while a toner for replenishment use (evaluation target: any of the toners TA-1 to TA-9 and TB-1 to TB-9) was supplied. Each time the image was output 10 times in the 500-time output, a reflection density of a blank portion of printed paper was measured using a reflectance densitometer (product of Tokyo Denshoku Co., Ltd.). A fogging density (FD) was calculated based on the following equation.

$$\text{Fogging density}=(\text{reflection density of blank portion})-(\text{reflection density of non-printed paper})$$

The highest fogging density (also referred to below as a "maximum fogging density") of all fogging densities (FD) measured at each timing in the 500-time continuous printing (each time the image was output 10 times) was determined. A measured maximum fogging density of less than 0.010 was evaluated as good, and a measured maximum fogging density of at least 0.010 was evaluated as poor.

(Anti-Adhesion Property)

The evaluation developer prepared through the above-described procedure was loaded in a multifunction peripheral ("TASKalfa 500ci", product of KYOCERA Document Solutions Inc.). An image having a printing rate of 20% was output 10,000 times in an environment at a temperature of 32.5° C. and a relative humidity of 80% using the multifunction peripheral while a toner for replenishment use (evaluation target: any of the toners TA-1 to TA-9 and TB-1 to TB-9) was supplied. Thereafter, an entirely-solid image was output using the multifunction peripheral and the solid image formed on paper was visually observed.

A solid image in which no dash mark was observed was evaluated as A (good), and a solid image in which a dash mark was observed was evaluated as B (poor). Note that the dash mark refers to an image defect caused due to adhesion of toner to a surface of a photosensitive drum.

[Evaluation Result]

Table 3 shows evaluation results for each of the toners TA-1 to TA-9 and TB-1 to TB-9. Under "Charge variation" in Table 3,"Low humidity" indicates a low-humidity charge retention rate, "High humidity" indicates a high-humidity charge retention rate, and "Actual" indicates an actual charge retention rate. In Table 3, "Anti-fogging" indicates a maximum fogging density, "Thermal resistance" indicates a result of evaluation of thermal-stress resistance (that is, an aggregation rate), and "Anti-adhesion" indicates a result of evaluation of the anti-adhesion property (that is, presence or absence of a dash mark).

TABLE 3

| | | Charge variation [%] | | | | Thermal resistance | |
|---|---|---|---|---|---|---|---|
| | Toner | Low humidity | High humidity | Actual | Anti-fogging | [% by mass] | Anti-adhesion |
| Example 1 | TA-1 | 125 | 63 | 78 | 0.004 | 1.5 | A |
| Example 2 | TA-2 | 129 | 70 | 80 | 0.003 | 1.9 | A |
| Example 3 | TA-3 | 120 | 56 | 71 | 0.005 | 1.2 | A |
| Example 4 | TA-4 | 123 | 58 | 86 | 0.003 | 1.6 | A |
| Example 5 | TA-5 | 110 | 53 | 92 | 0.002 | 1.8 | A |
| Example 6 | TA-6 | 128 | 67 | 75 | 0.005 | 1.3 | A |
| Example 7 | TA-7 | 120 | 63 | 72 | 0.005 | 1.3 | A |
| Example 8 | TA-8 | 128 | 67 | 80 | 0.004 | 1.5 | A |
| Example 9 | TA-9 | 125 | 58 | 82 | 0.003 | 1.5 | A |
| Comparative Example 1 | TB-1 | 108 | 25 | 85 | 0.003 | 1.5 | A |
| Comparative Example 2 | TB-2 | 162 | 72 | 73 | 0.005 | 1.4 | A |
| Comparative Example 3 | TB-3 | 110 | 30 | 62 | 0.008 | 1.8 | A |
| Comparative Example 4 | TB-4 | 124 | 71 | 42 | 0.022 | 1.2 | A |
| Comparative Example 5 | TB-5 | 127 | 57 | 75 | 0.003 | 3.5 | B |
| Comparative Example 6 | TB-6 | 115 | 48 | 91 | 0.002 | 5.0 | A |
| Comparative Example 7 | TB-7 | 135 | 70 | 64 | 0.007 | 2.3 | A |
| Comparative Example 8 | TB-8 | 120 | 28 | 68 | 0.006 | 2.2 | A |
| Comparative Example 9 | TB-9 | 123 | 65 | 39 | 0.023 | 1.4 | A |

Each of the toners TA-1 to TA-9 (toners according to Examples 1 to 9) was a positively chargeable toner having the aforementioned basic features. Specifically, each of the toners TA-1 to TA-9 included a plurality of toner particles each including a toner mother particle and an external additive attached to a surface of the toner mother particle. The external additive included the first resin particles (specifically, the first resin particles each having a surface to which a cationic surfactant was attached) and the second resin particles (specifically, the second particles each having a surface to which a cationic surfactant was attached). The first resin particles had a number average primary particle diameter of at least 30 nm and no greater than 65 nm, and the second resin particles had a number average primary particle diameter of at least 80 nm and no greater than 120 nm (see Tables 1 and 2). The first resin particles had a MW hydrophobicity of at least 15% and no greater than 30%, and the second resin particles had a MW hydrophobicity of at least 50% and no greater than 80% (see Tables 1 and 2). Each of the first resin particle coverage ratio and the second resin particle coverage ratio was at least 10% and no greater than 30% (see Table 1). Each BL rate of the first resin particles and the second resin particles was no greater than 30% by mass (see Tables 1 and 2).

As shown in Table 3, high-quality images could be formed continuously while fogging and adhesion of foreign matter to the photosensitive member were inhibited in continuous printing with any of the toners TA-1 to TA-9.

What is claimed is:

1. A positively chargeable toner comprising a plurality of toner particles each including a toner mother particle and an external additive attached to a surface of the toner mother particle, wherein the external additive includes first resin particles and second resin particles, each of the first resin particles having a surface to which a cationic surfactant is attached, each of the second resin particles having a surface to which a cationic surfactant is attached, the first resin particles having a number average primary particle diameter of at least 30 nm and no greater than 65 nm, the second resin particles having a number average primary particle diameter of at least 80 nm and no greater than 120 nm, the first resin particles have a hydrophobicity measured by a methanol wettability method of at least 15% and no greater than 30%, the second resin particles have a hydrophobicity measured by the methanol wettability method of at least 50% and no greater than 80%, an area ratio of a region of a surface region of the toner mother particle that is covered with the first resin particles is at least 10% and no greater than 30%, an area ratio of a region of the surface region of the toner mother particle that is covered with the second resin particles is at least 10% and no greater than 30%, a blocking rate as measured for the first resin particles using a mesh having an opening size of 75 μm after 5-minute application of a pressure of 0.1 kgf/mm$^2$ at a temperature of 160° C. to the first resin particles is no greater than 30% by mass, and a blocking rate as measured for the second resin particles using a mesh having an opening size of 75 μm after 5-minute application of a pressure of 0.1 kgf/mm$^2$ at a temperature of 160° C. to the second resin particles is no greater than 30% by mass.

2. The positively chargeable toner according to claim 1, wherein the toner mother particle contains a polyester resin, the first resin particle and the second resin particle each contain, independently of each other, a cross-linked styrene-acrylic acid-based resin, and the external additive further includes silica particles having a number average primary particle diameter of at least 3 nm and no greater than 20 nm.

3. The positively chargeable toner according to claim 2, wherein the cross-linked styrene-acrylic acid-based resin contained in the first resin particle and the cross-linked styrene-acrylic acid-based resin contained in the second resin particle each are, independently of each other, a polymer of monomers including a methacrylic acid alkyl ester having at an ester moiety thereof an alkyl group having a carbon number of at least 1 and no greater than 4, a styrene-based monomer, and a cross-linking agent having at least two unsaturated bonds, and the cationic surfactant attached to the surface of the first resin particle and the cationic surfactant attached to the surface of the second resin particle each are, independently of each other, a nitrogen-containing cationic surfactant.

4. The positively chargeable toner according to claim 3, wherein the cationic surfactant attached to the surface of the first resin particle and the cationic surfactant attached to the surface of the second resin particle each are, independently of each other, at least one surfactant selected from the group consisting of alkyl trimethylammonium salts having an alkyl group having a carbon number of at least 10 and no greater than 25 and alkylamine acetates having an alkyl group having a carbon number of at least 10 and no greater than 25.

5. The positively chargeable toner according to claim 2, wherein the toner mother particle includes a core and a shell layer covering a surface of the core, the core contains the polyester resin, the shell layer includes a resin film mainly formed from an agglomerated mass of resin particles having a glass transition point of at least 50° C. and no greater than 100° C., the resin particles forming the resin film have a number average roundness of at least 0.55 and no greater than 0.75, the resin particles of the shell layer contain a resin including a repeating unit derived from a styrene-based monomer, a repeating unit having an alcoholic hydroxyl group, and a repeating unit derived from a nitrogen-containing vinyl compound, and a repeating unit having a highest mass ratio among repeating units included in the resin contained in the resin particles is a repeating unit derived from a styrene-based monomer.

6. The positively chargeable toner according to claim 1, wherein a nonionic surfactant is further attached to at least one of the surface of the first resin particle and the surface of the second resin particle.

7. The positively chargeable toner according to claim 3, wherein the cross-linked styrene-acrylic acid-based resin contained in the first resin particle and the cross-linked styrene-acrylic acid-based resin contained in the second resin particle each are, independently of each other, a polymer of monomers including methyl methacrylate, styrene, and divinylbenzene.

8. The positively chargeable toner according to claim 5, wherein the repeating unit having an alcoholic hydroxyl group includes a repeating unit represented by a formula (1) shown below, (1)

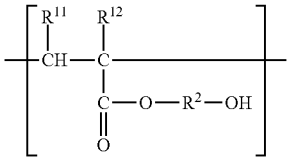

where in the formula (1), $R^{11}$ and $R^{12}$ each represent, independently of each other, a hydrogen atom, a halogen atom, or an alkyl group optionally substituted by a substituent, and $R^2$ represents an alkylene group optionally substituted by a substituent.

9. The positively chargeable toner according to claim 5, wherein the resin contained in the resin particles further includes at least one repeating unit derived from a (meth)acrylic acid alkyl ester.

10. A two-component developer comprising the positively chargeable toner according to claim 1, and a carrier that positively charges the positively chargeable toner by friction therewith.

* * * * *